US005460325A

United States Patent [19]

Surman

[11] Patent Number: 5,460,325

[45] Date of Patent: Oct. 24, 1995

[54] SOLAR LIT ADDRESS NUMBER ILLUMINATED MAILBOX STRUCTURE

[76] Inventor: Robert L. Surman, 37287 N. Hwy. 59, Lake Villa, Ill. 60046

[21] Appl. No.: 230,846

[22] Filed: Apr. 21, 1994

[51] Int. Cl.[6] ..... B65D 91/00

[52] U.S. Cl. ..... 232/17; 40/566

[58] Field of Search ..... 232/17, 38; 40/541, 40/566, 576; 362/20, 154, 163

[56] References Cited

U.S. PATENT DOCUMENTS

| | | | |
|---|---|---|---|
| D. 313,106 | 12/1990 | Hoffman et al. . | |
| 672,518 | 4/1901 | Wright | 232/17 |
| 736,815 | 8/1903 | Brown | 232/17 |
| 1,204,494 | 11/1916 | Sare | 232/38 |
| 1,613,759 | 1/1927 | Loftin | 362/154 |
| 1,659,351 | 2/1928 | Buccini | 232/13 |
| 1,789,239 | 5/1929 | Landgraf . | |
| 1,842,597 | 1/1932 | Foti | 362/154 |
| 2,420,699 | 5/1947 | Cox | 232/17 |
| 2,452,667 | 11/1948 | Lambert . | |
| 4,319,310 | 3/1982 | Kingsley . | |
| 4,410,930 | 10/1983 | Yachabach | 362/183 |
| 4,486,820 | 12/1984 | Baba et al. . | |
| 4,648,012 | 3/1987 | Pittman, II . | |
| 4,648,013 | 3/1987 | Curiel . | |
| 4,755,915 | 7/1988 | Rogers . | |
| 4,816,970 | 3/1989 | Garcia, Jr. . | |
| 4,872,610 | 10/1989 | Grabowiecki . | |
| 4,947,300 | 8/1990 | Wen . | |
| 4,989,124 | 1/1991 | Shappell . | |
| 5,007,190 | 4/1991 | Shyu | 40/576 |
| 5,101,329 | 3/1992 | Doyle | 362/183 |
| 5,107,637 | 4/1992 | Robbins | 362/183 |
| 5,143,285 | 9/1992 | Wise . | |

*Primary Examiner*—Michael J. Milano
*Attorney, Agent, or Firm*—Charles F. Meroni, Jr.

[57] ABSTRACT

This invention concerns a solar lit illuminated address number and mailbox structure comprising an open topped tray structure, a mailbox, a pivot pivotally connecting the mailbox to the open topped tray structure, solar energy collector structure exteriorly mounted on the mailbox, a circuit operatively connected to the solar energy collector structure mounted in the tray structure including a battery, and an address number light display mounted on an exterior surface of the mailbox electrically connected with the circuit and powered by the battery, the solar energy collector providing a power source and connected through the circuit to charge the battery, the mailbox structure being pivotal on the pivot to expose the circuit stored in the open topped tray structure.

19 Claims, 2 Drawing Sheets

SOLAR LIT ADDRESS NUMBER ILLUMINATED MAILBOX STRUCTURE

FIELD OF THE INVENTION

The present invention relates generally to a solar lit illuminated address number and mailbox structure. It is well known that often times it is difficult to find addresses of friends, relatives, business acquaintances and the like when traveling on the streets in an automobile or truck, particularly where traffic may be heavy or the streets may be poorly lit. This invention particularly concerns a new and improved apparatus or structure to provide illumination to address numbers provided on a mailbox structure to make it easier for passers by to read address numbers on mailboxes, particularly the rural type mailboxes that are commonly used in suburban and rural areas in the U.S.A. and elsewhere in the world.

DESCRIPTION OF THE PRIOR ART

Based on my knowledge of the prior art, I have found that it has been common practice to place painted unlit address numbers on a mailbox post or on a mailbox. Also, I have found that there are various solar panel circuits and devices that are shown in a number of prior art patents. Sometimes these mailbox numbers are light reflective. I am unaware of any usage, however, of electrically illuminated address numbers which are solar powered. This is an important advantage since electrical power is not generally available at a road side residential mailbox location.

SUMMARY OF THE INVENTION

According to my present invention I have provided in combination, a solar lit illuminated address number and mailbox structure comprising an open topped tray structure, a mailbox, pivot means pivotally connecting the mailbox to the open topped tray structure, solar energy collector structure exteriorly mounted on the mailbox, circuit means operatively connected to the solar energy collector structure mounted in the tray structure including a battery, an address number light display mounted on an exterior surface of the mailbox electrically connected with the circuit means and powered by the battery, the solar energy collector providing a power source and connected through the circuit means to charge the battery, the mailbox structure being pivotal on the pivot means to expose the circuit means stored in the open topped tray structure.

Another feature of my invention relates to the combination described above wherein the solar energy collector structure is generally U-shaped and sized to envelope an external outer surface of the mailbox in nested engagement therewith, and adhesive means connecting the solar energy collector structure to the outer surface of the mailbox.

Still another feature of my invention concerns the combination described above wherein manually operable latch means is provided between the open topped tray structure and the mailbox, the manually operable latch means being releasable to allow the mailbox to be pivoted on the pivot means so that access can be had to the circuit means mounted with an interior area of the open topped tray structure, the latch means being latchable again on pivoted movement of the mailbox on the pivot means to return the box to its latched position.

Yet another feature of my invention concerns the combination described above wherein the open topped stray structure defining a tray cavity with the circuit means being reposed in the tray cavity.

According to still further features of my invention concern the combination described above wherein the mailbox is comprised of a synthetic plastic and having downwardly angled lugs depending from a lower side of the mailbox, the pivot means further including fasteners extending through the lugs and sides of the open topped tray structure pivotally connecting the mailbox to the open topped tray structure.

An additional feature of my invention provides for a solar lit illuminated address number and mailbox structure comprising a solar energy collector structure including a series of panels, means securing the solar energy collector structure exteriorly to the mailbox, circuit means attached to the mailbox, the circuit means being operatively connected to the solar energy collector structure, the circuit means including a battery, an address number light display mounted on an exterior surface of the mailbox electrically connected to the circuit means and powered by the battery, the solar energy collector providing a power source and connected through the circuit means to charge the battery.

In accordance with another aspect of the invention, a solar lit illuminated address number and mailbox structure having a mailbox with an exterior surface and an underside is provided. The structure comprising a solar energy collector structure including a series of panels, means securing the solar energy collector structure exteriorly to the mailbox, circuit means attached to the mailbox, the circuit means being operatively connected to said solar energy collector structure, the circuit means including a battery, the mailbox having an interior mail compartment, an address number light display mounted on the exterior surface of the mailbox, the address number light display disposed in a planar relationship to the exterior surface of the mailbox so that the interior mail compartment remains free of encumbrance from the address number light display, the address number light display being electrically connected to said circuit means and powered by the battery, the solar energy collector providing a power source and connected through said circuit means to charge said battery, the mailbox having means defining a compartment on the underside, the battery and the electrical circuit being at least disposed in part in said compartment, the mailbox and the compartment being relatively movable with respect to one another to allow components such as the battery and the electrical circuit to be exposed for service.

Other objects, features and advantages of my invention will become more readily apparent upon reference to the following description when taken in conjunction with the accompanying drawings, which drawings illustrate several embodiments of my invention.

DETAILED DESCRIPTION OF THE PREFERRED EMBODIMENT

Figure 1:
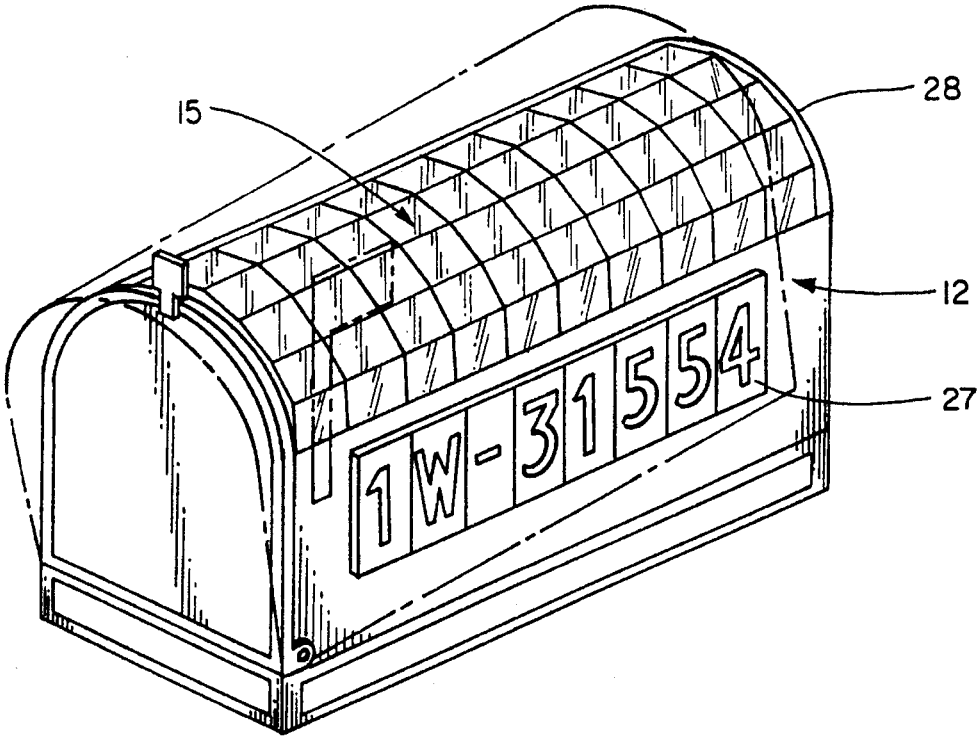
FIG. 1 is a perspective view of my solar lit illuminated address number and mailbox structure embodying important features of my invention.
Figure 2:
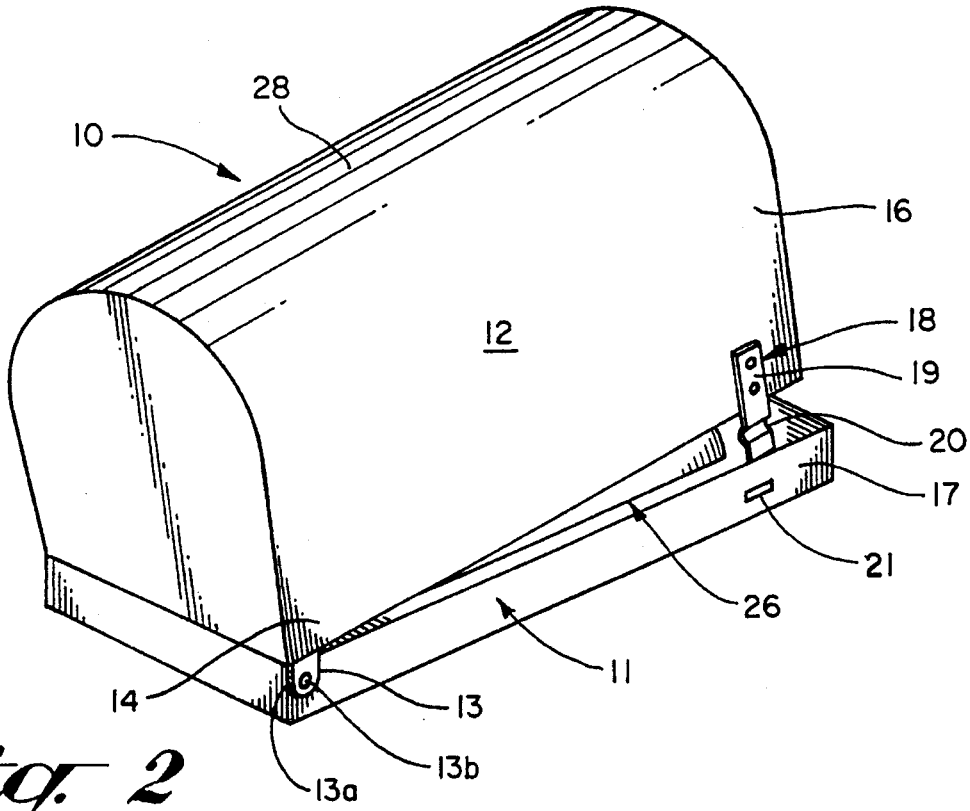
FIG. 2 is a perspective view similar to FIG. 1 only focusing on other details illustration how my mailbox structure can be pivotally mounted on a base or tray structure so that diagramatically illustrated circuitry or electronics can be protectively housed in the tray structure and covered by the mailbox.

Referring now to the drawings, FIG. 1 shows my new and improved Solar Lit Illuminated Address Number and Mailbox Structure as indicated at 10. This structure 10 further includes an open topped tray structure 11 and a mailbox 12 with an exterior surface,an underside, and an interior mail compartment therein. A pivot 13 pivotally connects a forward end of the mailbox 12 to a forward end of the open topped tray structure 11. The pivotally connected means 13 is illustrated in the form of plastic molded tabs 13*a*. These tabs 13*a* are disposed on opposite sides of the mailbox structure 10 shown in FIG. 2. A suitable nut and bolt fastener and/or the like 13*b* serves to secure the plastic molded tabs 13*a* to the open topped tray structure 11 as shown in FIG. 2. The tabs 13*a* serve to provide anchors for the fastener to connect the mailbox 12 to the open topped tray structure 11 by means of a fastener to enable the mailbox 12 to pivot on the fastener 13*b* which constitutes the pivot 13. When the mailbox 12 is pivoted, its free end 16 is caused to elevate away from the open topped opposite tray end 17 of the open topped tray structure 11. In order to enable the mailbox 12 to be securely positioned on the tray structure 11, I have provided a latch structure means 18 which could be located on opposite sides of the mailbox 12 or at the end 16, as desired. The latch 19 has an outwardly protruding grooved latch end 20 which is adapted to engage with a molded latch keeper or bulged latch member 21 to securely fix the ends 16 of the mailbox to the end 17 of the tray structure 11. When it is desired to disengage the latch, the latch end 20 is manually lifted off of the latch keeper 21 to disengage the latch 19 from the keeper so that the end 16 of the mailbox 12 can be elevated relative to the end 17 of the open topped tray structure 11 as seen in FIG. 2.

Figure 3:
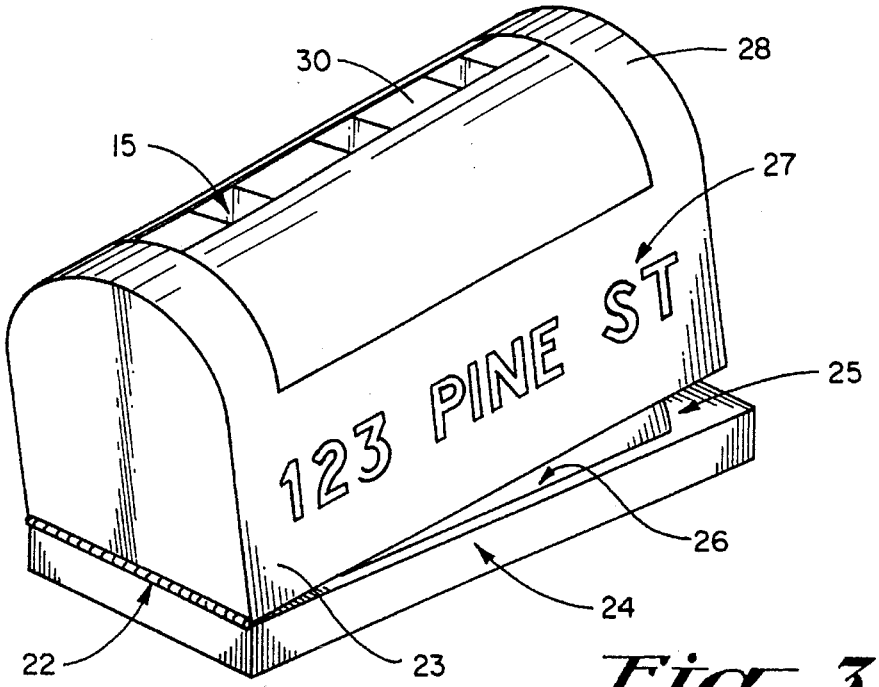
FIG. 3 is a perspective view of a mailbox structure similar to FIG. 2 only illustrating a modified plastic molded hinge for enabling the mailbox to pivot on the tray.
Figure 4:
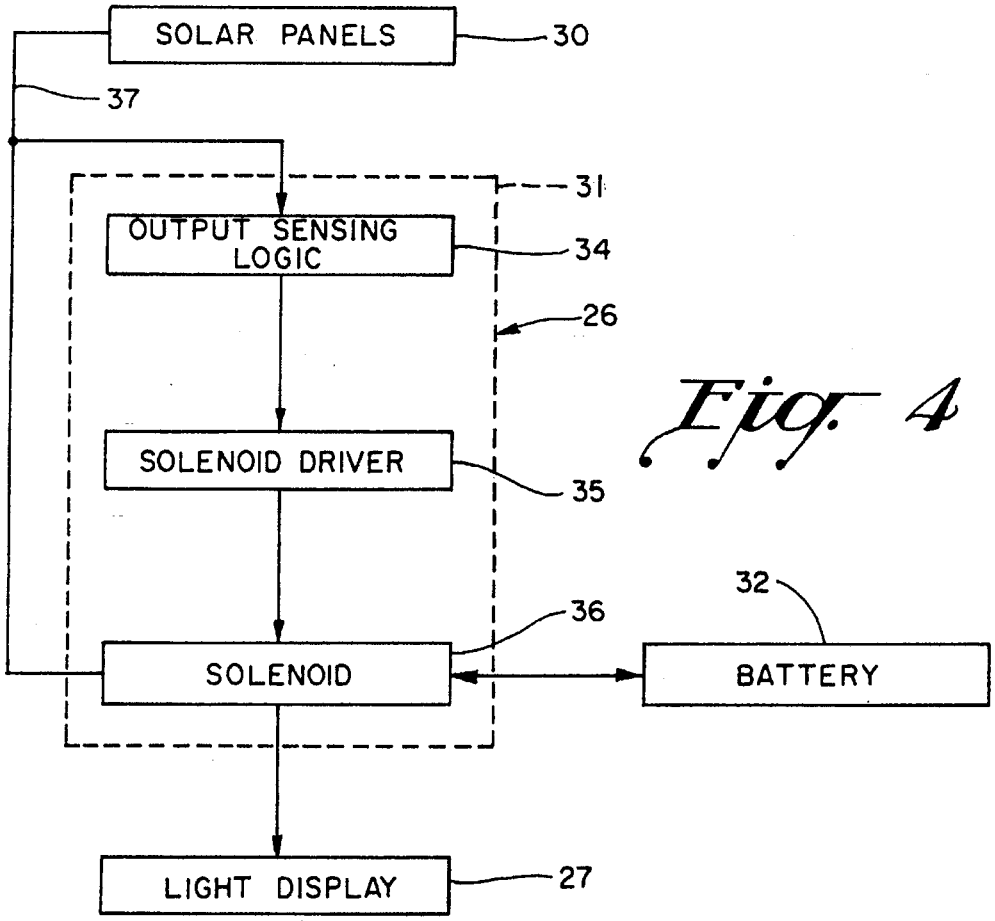
FIG. 4 is a schematic view of circuitry showing the way in which components can be electrically connected for the purpose of utilizing power from solar panels to charge a battery and light a light display mounted on a top or upper surface of a mailbox.

If desired, it will also be understood and appreciated that a plastic molded hinge structure 22, as shown in FIG. 3, can be molded integral with a mailbox 23 and an open topped tray structure 24 in such a way that then a pin can be inserted through hinge parts to connect the hinge parts together so that the mailbox 23 can pivot on the plastic molded hinge 22 relative to the open topped tray structure 24 to enable a person to gain access to an open area 25 where my electronics or circuit 26 is adapted to be disposed. Thus, the circuit 26 can be disposed in the tray area or cavity 25 as shown in FIG. 3 or in the corresponding open area also provided by the open topped tray structure 11 shown in FIG. 2.

Now it will also be appreciated that opposite sides of the mailbox 12 are adapted to be provided with an address number lighted display 27 as shown in FIG. 1. The solar collector 15 is generally of a U-shaped configuration so as to be in nested engagement with a top side 28 of my mailbox 12. The mailbox 12 can be of a metal construction or of a synthetic plastic construction, as desired.

The electronics or circuit 26 of my Improved Solar Powered Mailbox Illuminating System includes: solar panels 30 which comprise the solar energy collector structure that is attached by means of a suitable adhesive to the mailbox 12. The electronics or circuit 26 further includes a rechargeable battery 32, and the lighted display 27. The assembly enclosure 31 includes output sensing logic 34, a solenoid driver 35, and a solenoid 36.

In the daylight hours, the solar panels 30 receive sunlight so that output 37 increases in voltage. When the output 37 increases above a predetermined level the output sensing logic 34 electrically activates the solenoid driver 35. The solenoid driver 35 then triggers the solenoid 36, which electrically disconnects the rechargeable battery 32 from the light display 27, and electrically connects the output 37 of the solar panels 30 to the rechargeable battery 32. As a result, the output 37 from the solar panels 30 charges the rechargeable battery 32 in stored capacity for future illumination.

After sunset, when the output 37 of the solar panels 30 decreases in voltage below a predetermined level, the output sensing logic 34 electrically deactivates the solenoid driver 35. In addition, the solenoid driver 35 deactivates the solenoid 36. After being deactivated the solenoid 36 electrically disconnects the output 37 of the solar panels 30 from the rechargeable battery 32 and electrically connects the rechargeable battery 32 to the light display 27. As a result, the rechargeable battery 32 illuminates the light display 27 for viewing of my Improved Solar Powered Mailbox Illuminating System on opposite sides of the mailbox 12.

As various possible embodiments may be made in the above invention for use for different purposes and as various changes might be made in the embodiments and method above set forth, it is understood that all of the above matters here set forth or shown in the accompanying drawings are to be interpreted as illustrative and not in a limiting sense.

I claim:

1. In combination, a solar lit illuminated address number and mailbox structure comprising an open topped tray structure, a mailbox, pivot means pivotally connecting the mailbox to said open topped tray structure, solar energy collector structure exteriorly mounted on the mailbox, circuit means operatively connected to said solar energy collector structure mounted in the tray structure including a battery, an address number light display mounted on an exterior surface of the mailbox electrically connected with said circuit means and powered by the battery, the solar energy collector providing a power source and connected through said circuit means to charge said battery, the mailbox structure being pivotal pivot means to expose the circuit means stored in said open topped tray structure.

2. The combination of claim 1 wherein the solar energy collector structure is generally U-shaped and sized to envelope an external outer surface of the mailbox in nested engagement therewith, and adhesive means connecting the solar energy collector structure to the outer surface of the mailbox.

3. The combination of claim 1 wherein manually operable latch means is provided between the open topped tray structure and the mailbox, the manually operable latch means being releasable to allow the mailbox to be pivoted on said pivot means so that access can be had to the circuit means mounted with an interior area of the open topped tray structure, the latch means being latchable again on pivoted movement of the mailbox on said pivot means to return the box to its latched position.

4. The combination of claim 1 wherein the open topped tray structure defines a tray cavity with said circuit means being reposed in the tray cavity.

5. The combination of claim 1 wherein the mailbox is comprised of a synthetic plastic and has downwardly angled lugs depending from a lower side of the mailbox, the pivot means further including fasteners extending through the lugs and sides of the open topped tray structure pivotally connecting the mailbox to the open topped tray structure.

6. The combination of claim 1 wherein the mailbox is comprised of a synthetic plastic and has a hinge structure at one end of the mailbox which comprises said pivot means, the hinge structure enabling the mailbox to be pivoted on its end to provide access to the open topped tray structure for viewing of the circuit means housed in a cavity defined by the open topped tray structure, the bottom of the mailbox serving as a lid to close the cavity when the mailbox is pivoted to a closed position overlying the open topped tray structure.

7. The combination of claim 1 wherein the pivot means pivotally connects the mailbox at one end to said open topped tray structure.

8. The combination of claim 1 wherein the solar energy collector structure is generally U-shaped and sized to envelope an external outer surface of the mailbox in nested engagement therewith, and adhesive means connecting the solar energy collector structure to the outer surface of the mailbox.

9. The combination of claim 1 wherein the exterior surface bearing the address number like display is disposed at one side of the mailbox.

10. In combination, a solar lit illuminated address number and mailbox structure comprising an open topped tray structure, a mailbox, pivot means pivotally connecting the mailbox to said open topped tray structure, solar energy collector structure comprising a series of panels secured exteriorly to the mailbox, circuit means disposed in a cavity defined by said open topped tray structure, the circuit means being operatively connected to said solar energy collector structure, the circuit means including a battery, an address number light display mounted on an exterior surface of the mailbox electrically connected to said circuit means and powered by the battery, the solar energy collector providing a power source and connected through said circuit means to charge said battery, the mailbox structure being pivotal on said pivot means to expose the circuit means stored in said open topped tray structure.

11. The combination of claim 10 wherein the address mounted display is mounted on one side of the mailbox.

12. The combination of claim 10 wherein the address mounted display is mounted on both sides of the mailbox.

13. The combination of claim 10 wherein the pivot means pivotally connects the mailbox at one end to said open topped tray structure.

14. The combination of claim 10 wherein the address mounted display is mounted on one side of the mailbox.

15. A solar lit illuminated address number and mailbox structure having a mailbox with an exterior surface and an underside, the structure comprising a solar energy collector structure including a series of panels, means securing the solar energy collector structure exteriorly to the mailbox, circuit means attached to the mailbox, the circuit means being operatively connected to said solar energy collector structure, the circuit means including a battery, the mailbox having an interior mail compartment an address number light display mounted on the exterior surface of the mailbox the address number light display disposed in a planar relationship to the exterior surface of the mailbox so that the interior mail compartment remains free of encumbrance from the address number light display, the address number light display being electrically connected to said circuit means and powered by the battery, the solar energy collector providing a power source and connected through said circuit means to charge said battery, the mailbox having means defining a compartment on the underside, the battery and the electrical circuit being at least disposed in part in said compartment, the mailbox and the compartment being relatively movable with respect to one another to allow components such as the battery and the electrical circuit to be exposed for service.

16. The solar lit illuminated address number and mailbox structure of claim 15 wherein the address mounted display is mounted on one side of the mailbox.

17. The solar lit illuminated address number and mailbox structure of claim 15 wherein the address mounted display is mounted on both sides of the mailbox.

18. The solar lit illuminated address number and mailbox structure of claim 15 wherein the circuit means is stored on the underside of the mailbox. .

19. The solar lit illuminated address number and mailbox structure of claim 15 wherein housing means is provided for the mailbox structure and said circuit is stored therein and electronically connected to said address number light display.

* * * * *